US006385824B1

(12) United States Patent
Schwartz

(10) Patent No.: US 6,385,824 B1
(45) Date of Patent: May 14, 2002

(54) REUSABLE CASKET ASSEMBLY

(76) Inventor: Dale L. Schwartz, P.O. Box 1371, Hutchinson, KS (US) 67501

( * ) Notice: Subject to any disclaimer, the term of this patent is extended or adjusted under 35 U.S.C. 154(b) by 0 days.

(21) Appl. No.: 09/464,028

(22) Filed: Dec. 15, 1999

Related U.S. Application Data

(60) Provisional application No. 60/128,930, filed on Apr. 13, 1999.

(51) Int. Cl.[7] ..... A61G 17/00

(52) U.S. Cl. ..... 27/35; 52/128; 52/138

(58) Field of Search ..... 27/2, 15, 27, 35; 52/128, 133, 138, 139; 220/23.87, 23.89, 23.83, 23.91; 403/408.1

(56) References Cited

U.S. PATENT DOCUMENTS

| | | | | |
|---|---|---|---|---|
| 458,527 | A | * | 8/1891 | Freshl |
| 1,001,424 | A | | 8/1911 | Montross |
| 1,833,547 | A | * | 11/1931 | Wollitz |
| 2,431,183 | A | * | 11/1947 | Mansfield |
| 3,050,818 | A | | 8/1962 | Phillips |
| 3,133,334 | A | | 5/1964 | Johnsen |
| 3,654,676 | A | | 4/1972 | McHugh |
| 3,810,282 | A | | 5/1974 | Doggett |
| 3,815,185 | A | | 6/1974 | Owens |
| 4,063,337 | A | | 12/1977 | Havey, III |
| 4,139,929 | A | | 2/1979 | Angerman |
| 4,176,431 | A | | 12/1979 | Havey, III |
| 4,177,543 | A | * | 12/1979 | Angermann |
| 4,237,590 | A | | 12/1980 | Work |
| 4,265,006 | A | | 5/1981 | Angermann |
| 4,372,018 | A | | 2/1983 | Miller |
| 4,823,448 | A | | 4/1989 | Martin |
| 4,854,018 | A | | 8/1989 | Von Bratt |
| 5,481,785 | A | | 1/1996 | Minton et al. |
| 5,592,723 | A | | 1/1997 | Leijonhufvud et al. |
| 5,740,592 | A | | 4/1998 | Lau |
| 5,784,768 | A | | 7/1998 | Rojdev |
| 5,815,898 | A | | 10/1998 | Jenkins |

* cited by examiner

*Primary Examiner*—Jack Lavinder
*Assistant Examiner*—William L. Miller
(74) *Attorney, Agent, or Firm*—Kilpatrick Stockton LLP

(57) ABSTRACT

A reusable casket assembly includes a closable burial compartment configured to accommodate enclosure of a body within its interior. The burial compartment may be releasably attached inside a decorative casket shell thereby allowing disengagement of the burial compartment from the casket shell for burial of the compartment exclusive of the casket shell which may be reused with a different burial compartment.

14 Claims, 5 Drawing Sheets

REUSABLE CASKET ASSEMBLY

RELATED PATENT APPLICATIONS

This patent application claims priority to U.S. Provisional Application No. 60/128,930 filed Apr. 13, 1999 entitled REUSABLE CASKET ASSEMBLY. Said application in its entirety is hereby expressly incorporated by reference into the present application.

TECHNICAL FIELD

The present invention relates generally to interment caskets, and more specifically to a casket assembly wherein a removable casket shell may be attached over a burial box or compartment until the time of closing the grave, at which point the casket shell may be removed for future reuse with a different burial compartment.

BACKGROUND ART

The traditional design of burial caskets includes both surface ornamentation, and selection of attractive materials such as chromium plated metals and polished hardwoods. As a result, even the simplest of burial caskets represents an expensive purchase, to only be later buried. This expense could be reduced by including reusable parts in the construction of the casket.

U.S. Pat. No. 5,784,768 describes a casket having a quickly interchangeable and adjustable interior. The patent addresses longitudinal fastening elements disposed along the upper edge of the internal chamber of the casket. A female fastening element, secured inside the chamber, receives male fastening elements that have draped fabric attached to them, to decorate the inside of the casket chamber. The patent provides for variation of fabric decoration inside the casket and possible reuse of such decoration if it is removed from the casket prior to burial. While decorative fabrics may be expensive, their impact on cost reduction, through reuse, is relatively small. A better approach to cost reduction would be avoidance of burial of the ornate casket structure and providing a way to reuse that structure, or at least a portion thereof.

In view of the above described deficiencies associated with the use of known designs for burial caskets, the present invention has been developed to alleviate these drawbacks and provide further benefits to the user. These enhancements and benefits are described in greater detail hereinbelow with respect to several alternative embodiments of the present invention.

DISCLOSURE OF THE INVENTION

The present invention in its several disclosed embodiments alleviates the drawbacks described above with respect to conventionally designed interment caskets and incorporates several additionally beneficial features. Features of interest include the provision of an ornamental casket shell that may be re-used numerous times to cover a plurality of burial compartments, each one of which remains in the grave after detachment of the reusable casket shell. Each burial compartment includes a closure so that the compartment becomes an enclosed compartment, isolated from its surroundings, with the closure in its closed position. The design of captive closures, for burial compartments of the invention, allows them to slide lengthwise, between an open and a closed position, in channels or grooves formed in the inner sidewalls of a burial compartment. Alternatively, a detached board or door, sized to fit the burial compartment opening, may be used as a closure. No matter whether captive or detached, closures of the invention, in their closed position, also include mechanisms for maintaining them in a secured condition.

Since only the closed and secured burial compartment is subject to actual burial, and the casket shell may be reused, the casket assembly of the invention is less costly traditional caskets. The invention benefits from the attractive appearance of the ornamental casket shell, placed over the burial compartment, while reducing the effective expense of the shell through cost defraying, multiple uses with other burial compartments. By combining an ornamental, reusable casket shell with an economical burial compartment, made from low cost materials, the casket assembly of the invention provides an attractive, low-cost alternative to conventional ornate caskets of traditional design.

Formation of the reusable casket assembly of the invention requires attachment of the casket shell to the burial compartment. This involves a variety of means for releasably connecting the casket shell to the burial compartment including bolted, latched or clamped connections.

More specifically, the reusable casket assembly of the invention includes a closable burial compartment configured to accommodate enclosure of a body within its interior. The burial compartment may be releasably attached inside a decorative casket shell thereby allowing disengagement of the burial compartment from the casket shell for burial of the compartment exclusive of the casket shell which may be reused with a different burial compartment. Releasable attachment of the burial compartment to the casket shell uses several methods including clamps, brackets, latches, and coupling bars terminated with knobs or grips or toggles and the like.

One embodiment of the closable burial compartment includes a closure, sized to fill the open top of the compartment. The closure may be attached to the burial compartment or separate therefrom to be secured in place just before interment. Any number of suitable mechanisms and methods of securement, such as the use of latches, screws, nut and bolt combinations and the like represent appropriate ways to securely retain the closure in the closed position.

The beneficial effects described above apply generally to the exemplary devices and mechanisms disclosed herein of the reusable casket assembly. The specific structures through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Furthermore, elements may be recited as being "coupled"; this terminology's use contemplates elements being connected together in such a way that there may be other components interstitially located between the specified elements, and that the elements so specified may be connected in fixed or movable relation one to the other.

Figure 1:
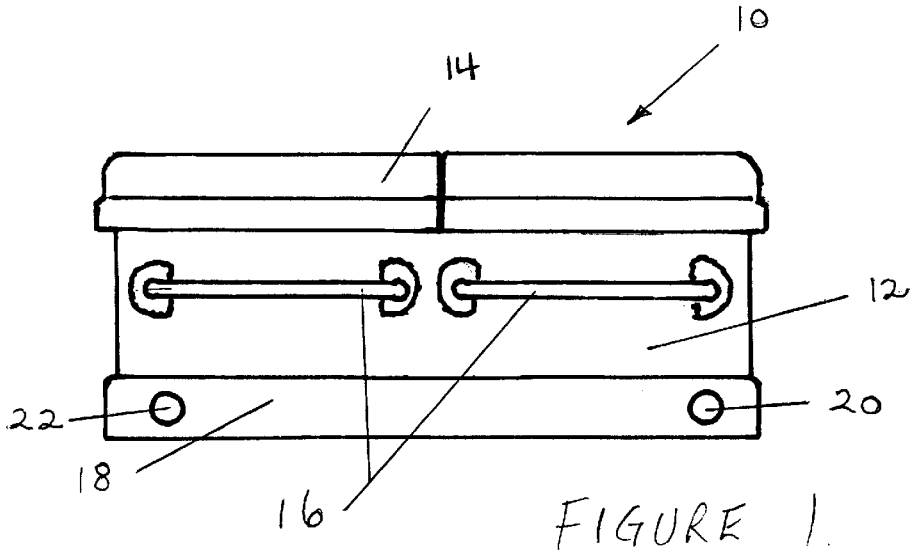
FIG. 1 is an elevational view of the reusable casket assembly of the invention.

Referring to the Figures and using like reference numerals to identify like parts throughout the several views, FIG. 1 shows a side elevation of the reusable casket assembly 10 of the invention. The view shows an ornamental casket shell 12, with exterior features typical of traditional caskets, including a split hinged lid 14, one or both sections of which may be raised to facilitate viewing of a deceased person resting therein. Both sides of the casket assembly 10 have a rail of suitable size for carrying of the assembly 10. FIG. 1 shows such a rail 16, in this case a divided rail for raising the casket assembly 10. Also in FIG. 1, a base 18 of the casket shell 12 includes a first hole 20 and a second hole 22. These holes 20,22 are in axial alignment with holes in the base 18 of the opposite side of the casket shell 12.

Figure 2:
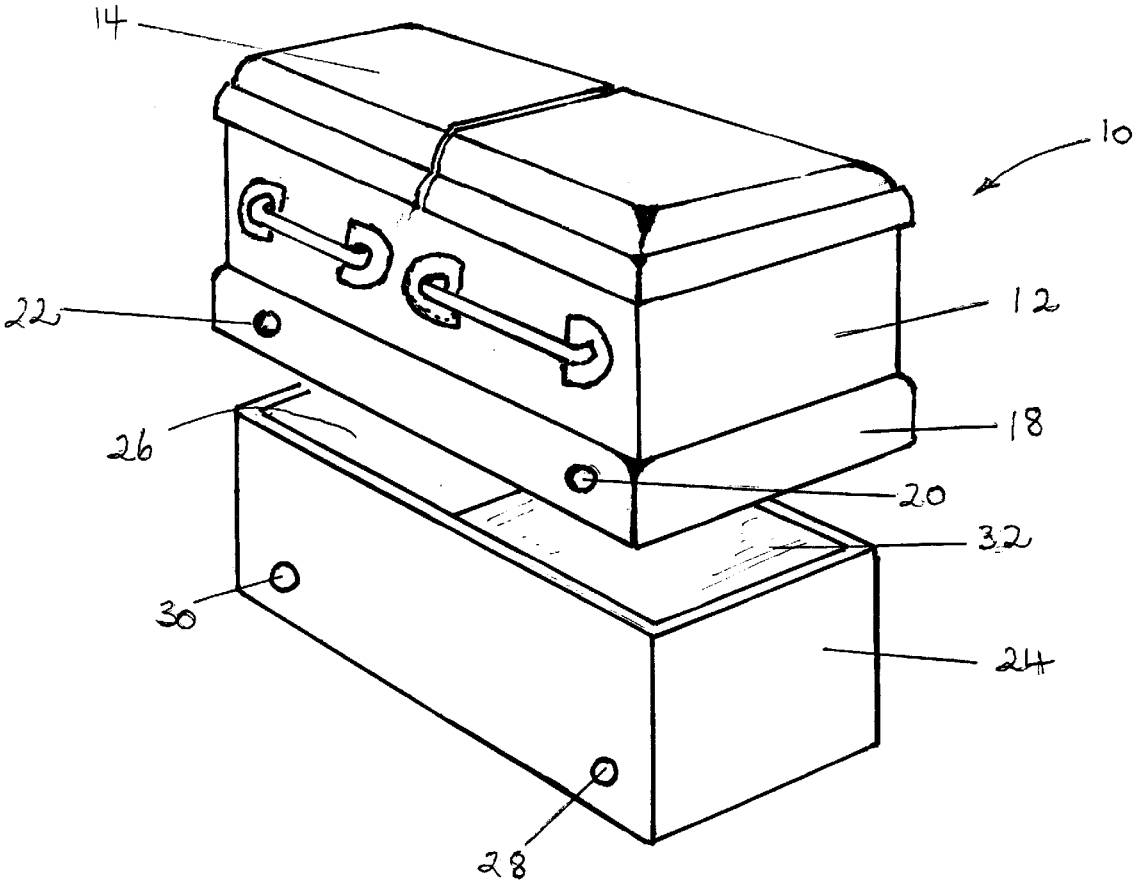
FIG. 2 is an exploded perspective view showing a casket shell and burial compartment of the current invention.

FIG. 2 provides an exploded perspective view including both major parts of the assembly 10 of the invention. In this case, raising the casket shell 12 reveals the burial compartment 24 which is essentially a rectangular box with an open top 26. The burial compartment includes a first port 28 and a second port 30. These ports 28,30 are in axial alignment with respective ports (not shown) on the opposite side of the burial compartment 24. The holes 20,22 of the casket shell 12 and ports 28,30 of the burial compartment 24 line up with each other as part of an open channel which extends through the base 18 on both sides of the casket shell 12 with the burial compartment 24 located within the casket shell 12 and attached thereto to form the reusable casket assembly of the invention. Reusability resides with the casket shell 12 which detaches from the burial compartment 24 before burying the compartment 24 in the ground. Entombment of the compartment 24 requires positioning of a closure 32 to close the open top of the burial compartment 24 and essentially seal it from its surroundings. Preferably, the positioning process provides secure attachment of the closure 32 to the burial compartment 24. Such secure attachment could use a variety of holding devices including latches, bolted joints, screws or a variety of lengths of sealing strips relying on adhesive or mechanical fastening.

Figure 3:
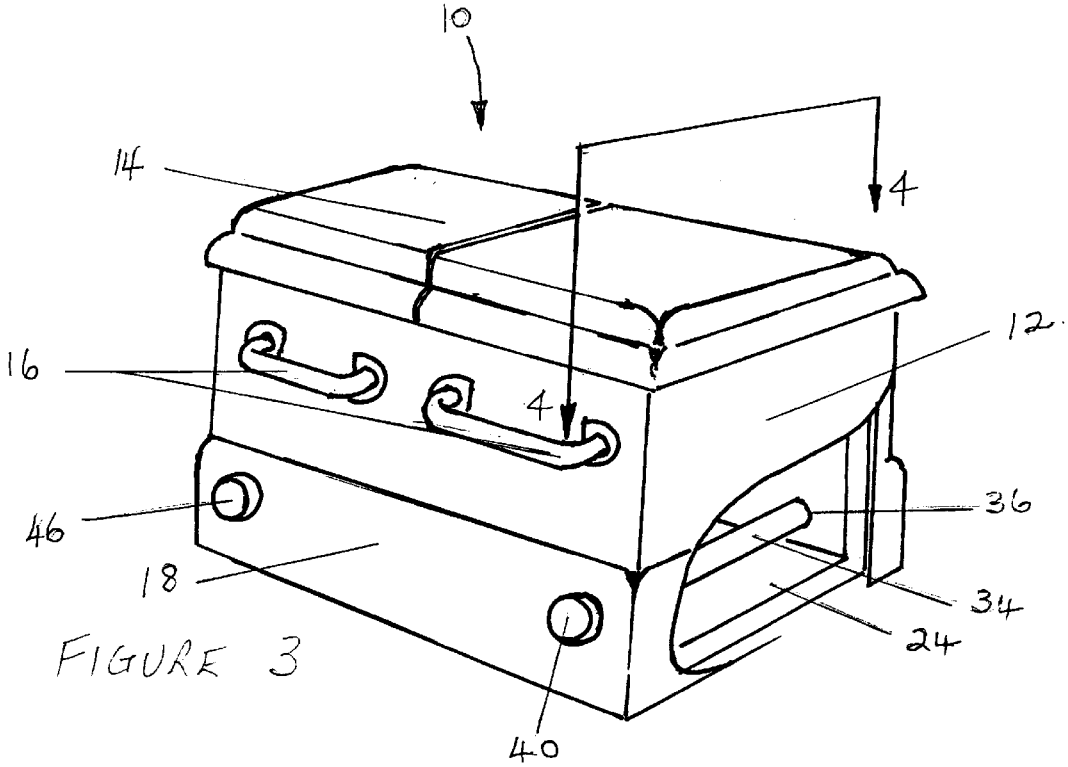
FIG. 3 is a perspective view of a reusable casket assembly including a cutaway section to reveal one means of attaching the burial compartment to the reusable casket shell.
Figure 4:
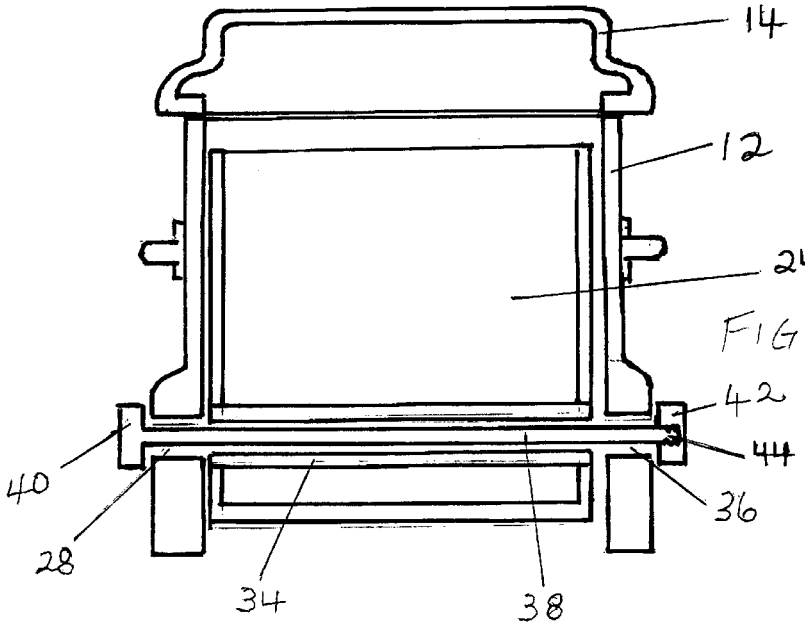
FIG. 4 provides a cross sectional view taken along line 4—4 of FIG. 3.

FIG. 3 shows a perspective view of the reusable casket assembly 10 of the invention including a cutaway portion to reveal a preferred method of forming attachment of the casket shell 12 to the burial compartment 24. The shell 12 covers the burial container 24 which has a tube 34 seated in the port 28 then extending the width of the burial compartment 24 to seat in an opposing port 36 in the opposite wall of the burial compartment 24. A coupling bar 38 (see FIG. 4), positioned inside the tube 34, has sufficient length to extend beyond the sides of the casket shell 12. An ornamental end block 40, exceeding the dimensions of the hole 20 in the casket shell 12, provides means to retain the coupling bar 38 in a position to effect attachment of the casket shell 12 to the burial compartment 24. The ornamental end block 40 and the corresponding block (not shown), attached outside the shell 12 on the other end of the coupling bar 38, may be threaded blocks to engage threads formed on the ends of the bar 38. Alternatively, one end block may be integrally molded on one end of the coupling bar 38, the other end of the bar 38 being threaded to receive a similarly threaded end block. FIG. 4, which is a cross sectional view taken through line 4—4 of FIG. 3, shows the burial compartment 24 held inside the casket shell 12 using a coupling bar 38 located inside the tube 34 which spans the width of the burial compartment 24 with its ends seated in ports 28,36 formed in the burial compartment 24. In this case, the coupling bar 38 has an integrally molded end block 40 on one end of the coupling bar 38 and a threaded end block 42 engaging a threaded section 44 on the other end of the bar 38 to secure the connection between the casket shell 12 and the burial compartment 24. Preferably, the reusable casket assembly of the invention includes a coupling bar 38 at each end of the base 18. A decorative block 46 shown in FIG. 3 indicates the formation of a second point of attachment between the casket shell 12 and the burial compartment 24.

The tube 34 must not interfere with an adjustable frame and elevating mechanism (not shown) which may be part of the burial compartment 24. Such a mechanism is well known, to those skilled in the art, for raising a body for viewing and thereafter lowering the body to facilitate closing of the casket lid 14. Avoidance of conflict between the tube 34 and the elevating mechanism requires positioning of the tube 34 underneath the mechanism thereby leaving sufficient space to prevent interference.

Figure 5:
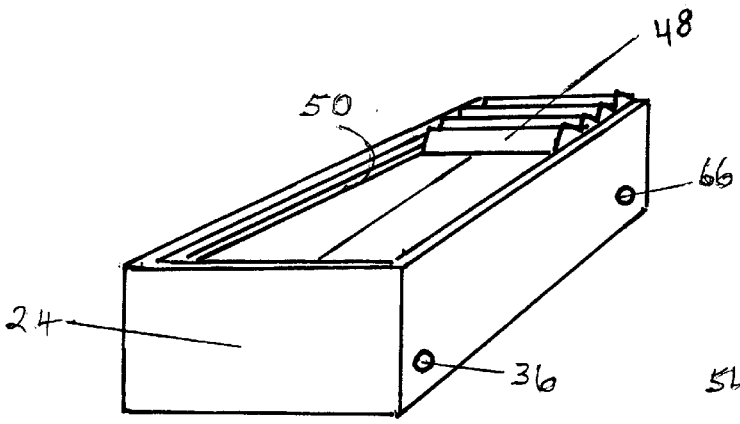
FIG. 5 is a perspective view of a burial compartment of the invention including one form of captive closure.
Figure 6:
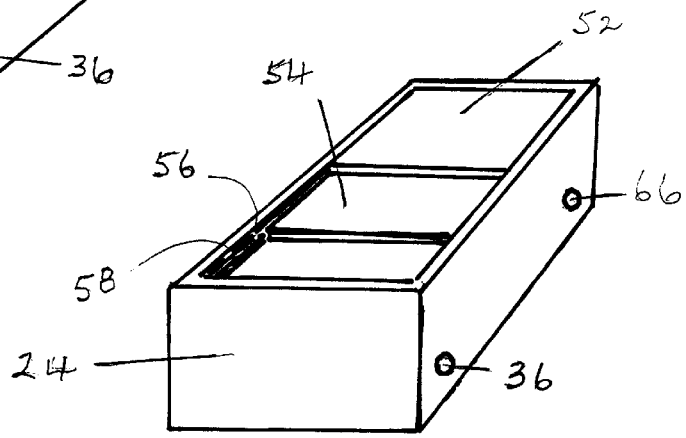
FIG. 6 shows a perspective view of a burial compartment including an alternative form of captive closure differing from FIG. 5.
Figure 7:
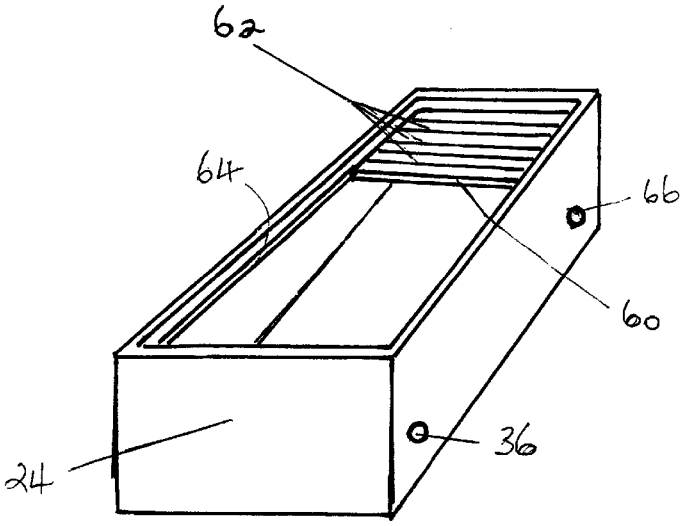
FIG. 7 provides a perspective view of burial compartment of the invention including a further variation of a captive closure.

FIG. 5, FIG. 6 and FIG. 7 show perspective views of burial compartments 24 differing only in the type of closure used to cover and preferably seal the compartment 24. The closure 48 of FIG. 5 is a folded cover, sometimes referred to as z-folded or accordion folded, which moves lengthwise along a groove 50 until it stretches over the open top of the burial compartment 24. When fully extended to cover the compartment 24, the closure 48 may secured to the burial compartment 24 using suitable fastening devices such as latches, studs, bolts, screws, and other mechanisms that are designed to retain the closure 48 as a covering for the burial compartment 24.

The closure of FIG. 6 comprises two sliding panels 52,54. These panels 52,54 may slide independently one from the other, each in its own channel 56,58. When the first panel 52 is positioned above the second panel 54, a section or area of the burial compartment 24 becomes exposed. The dimensions of the exposed section provide a suitable area for viewing the deceased person resting therein. Before final interment, the closure 52,54 is slid closed to cover the burial compartment 24 and is then secured in position by activating a latch or other suitable method of securement as discussed previously.

FIG. 7 illustrates a burial compartment 24 using a retractable closure 60 including multiple hinged strips 62. The closure moves in a guide 64 to provide controlled opening and closing of the closure 60. For effective use of this type of closure, the burial compartment includes a mandrel to store the closure that wraps around the mandrel as it moves along the guide from a closed to an open configuration.

The view of the burial compartment 24 shown in FIG. 5 reveals a rear port 66 for seating an end of a tube such as that described as tube 34 which cooperates with the coupling bar 38 for attaching the casket shell 12 to the burial compartment 24. A second tube also extends between opposing ports. Provision of the tube and coupling bar attachment at each end of the base 18 of the reusable casket assembly 10 enables a secure attachment between the burial compartment 24 inside a casket shell 12. Because of such securement, the several component parts of the assembly 10 may be lifted together as a single unit. However, separation of the casket shell 12 from the burial compartment 24 requires only removal of a threaded ornamental block from each coupling bar, followed by withdrawal of each coupling bar from its respective tube.

Figure 8:
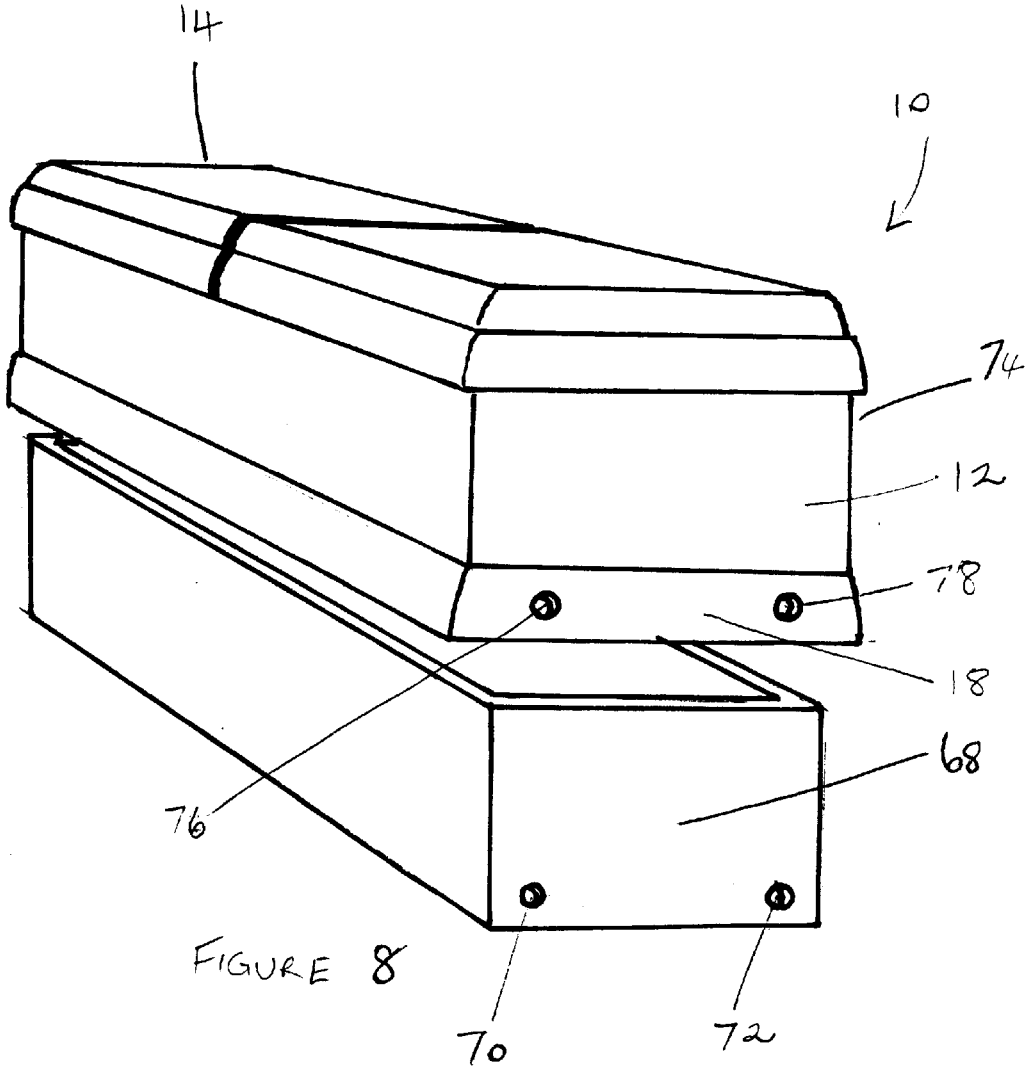
FIG. 8 is an exploded perspective view showing an alternative structure for a casket shell and burial compartment of the current invention.
Figure 9:
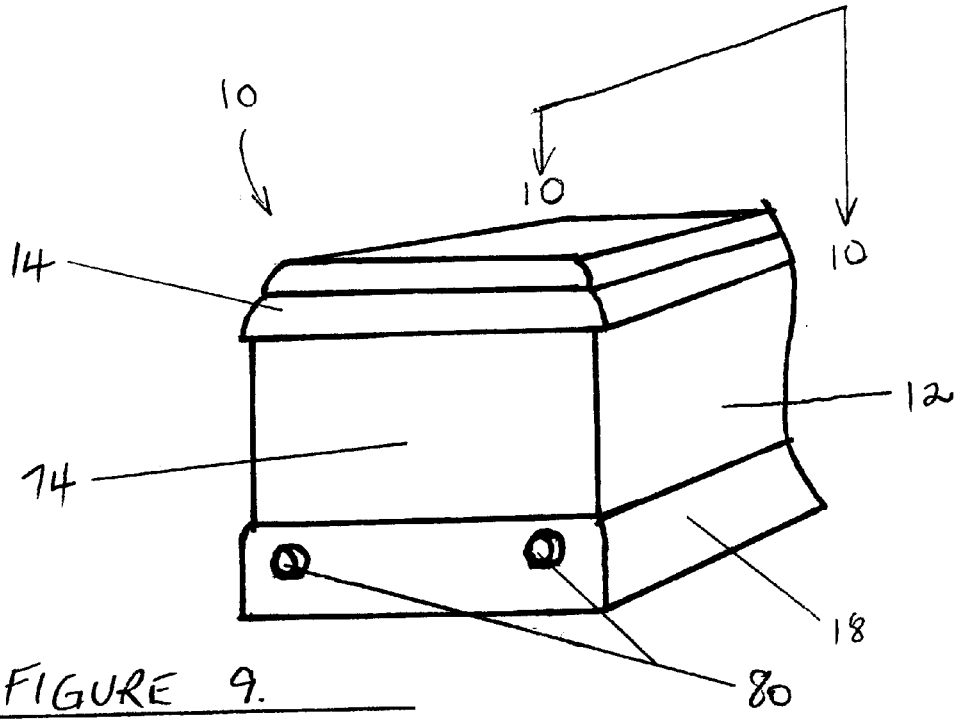
FIG. 9 is a partial perspective view of the casket assembly indicating positioning of connector pins.
Figure 10:
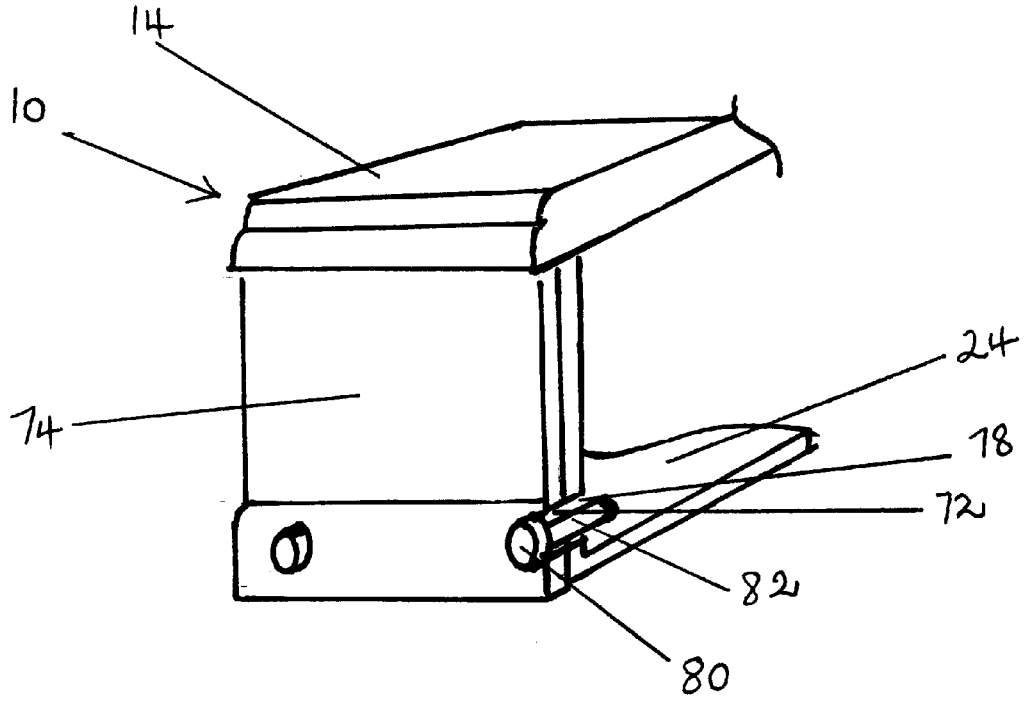
FIG. 10 is a partial perspective view of the casket assembly showing a cutaway 25 section taken through line 10—10 of FIG. 9.

FIG. 8 illustrates an alternative form of a reusable casket assembly according to the present invention. This version differs from the casket assembly of FIG. 2 primarily in the positioning of the ports found in the burial compartment 24 and the openings in the casket shell 12. In this example, the casket assembly 10 includes a burial compartment 24 having an end wall 68 with a first end port 70 and a second end port 72; each such port 70,72 being positioned at a corner of a lower edge of the end wall 68. The casket assembly 10 also includes a casket shell 12 having a shell end-wall 74 and first 76 and second 78 shell openings positioned at opposing ends of the casket base 18 of the shell end wall 74. With the casket shell 12 covering the burial compartment 24, as in a fully assembled casket, the first end port 70 aligns with the first shell opening 76 while the second end port 72 and the second shell opening 78 also adopt an aligned configuration. Opposite endwalls of the casket shell 12 and the burial compartment 24 also include ports and openings at their lower corners, corresponding to those illustrated in FIG. 8. With ports and openings aligned at lower corners of the assembly 10, the combination assembly 10 includes a casket shell 12 and a burial compartment 24. Suitably sized rods 82 or bolts with decorative heads 80 are inserted into the aligned apertures, such as the port 70 and opening 76, which are paired at each of four corners of the assembly 10. This provides a four-point connection of the burial compartment 24 to the casket shell 12 that allows the casket assembly 10 to be lifted and moved about as a unit. The ports, 70,72 and openings 76,78 may be reinforced to fulfill their load-bearing function. Suitable reinforcement includes the use of metal inserts to protect the circumference of the ports 70,72. The openings 76,78 are aligned to receive the rods or decorative bolts used as connector pins therebetween. Such connector pins are shorter in length and often more convenient to use than the transverse coupling bars 38 included in FIG. 4. Also, the use of hardened connector pins removes the need for additional machining to form screw sections along bolts or rods, although such an option may be selected for more rigid nut and bolt connection of a casket shell 12 to a burial compartment 24.

In traditional fashion, once assembled, the casket shell 12 and burial compartment 24 may be decorated with fabric draperies and other types of ornamentation prior to ceremonial use. Due to the reusable nature of the casket shell, such decoration may be removably attached thereby accommodating easy changes to the exterior appearance of the casket shell. Suitable embodiments of fasteners that facilitate removable attachment of such draperies include interference fasteners, such as hook-and-loop fasteners, snaps, zippers and the like.

A reusable casket assembly and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by Letters Patent is as follows:

1. A burial casket assembly for accommodating inexpensive burials, said burial casket assembly comprising:

a closable burial compartment configured to accommodate enclosure of a body within an interior thereof for burial, said compartment adapted for releasable attachment within a decorative casket shell thereby accommodating disengagement of said compartment from said decorative casket shell for burial of said compartment exclusive of said decorative casket shell;

a releasable coupling assembly configured for coupling and releasing said compartment from said decorative casket shell;

said releasable coupling assembly including a tubular receiver disposed within a lower portion of said compartment, said tubular receiver extending across a width of said compartment and configured to insertably receive a coupling bar therein for affecting a connection between said compartment and said decorative casket shell;

said tubular receiver including a pair of ports, one of each said ports located at each of two ends of said tubular receiver and each of said ports configured to permit insertion of said coupling bar therethrough into said tubular receiver; and said decorative casket shell including a pair of apertures configured to insertably receive said coupling bar therethrough, said pair of apertures in said decorative casket shell being oriented to align with said pair of ports in said compartment when said decorative casket shell is properly positioned relative to said compartment for interconnection via said releasable coupling assembly.

2. The burial casket assembly as recited in claim 1, further comprising:

a body of said compartment being substantially rigid so that said compartment retains shape when disengaged from said casket shell for burial.

3. The burial casket assembly as recited in claim 1, further comprising:

said compartment having a top opening and a closure member for closing said top opening at least prior to burial of said compartment.

4. The burial casket assembly as recited in claim 3, said closure member being a sliding door adapted to be moved into a closed position at least prior to burial of said compartment.

5. The burial casket assembly as recited in claim 4, said top opening comprising only a portion of a top side of said compartment and said top opening being positioned at a head end of said compartment for accommodating exposure of an upper torso region of an enclosed body for viewing purposes; and said closure member adapted to be slid toward a foot end of said compartment for opening said top opening when in an open configuration and to be slid toward said head end for closing said top opening when in a closed configuration.

6. The burial casket assembly as recited in claim 5, further comprising:

longitudinal tracks positioned proximate said top side of said compartment and running from said head end to said foot end of said compartment; and said closure member engageable in said tracks and adapted to be slid between said open configuration and said closed configuration in said tracks.

7. The burial casket assembly as recited in claim 6, said closure member having side edge portions, said side edge portions being configured for insertion of said tracks for accommodating sliding of said closure member between said open configuration and said closed configuration in said tracks.

8. The burial casket assembly as recited in claim 1, further comprising:

said coupling bar extended through said pair of apertures in said decorative casket shell and said pair of ports in said compartment thereby interconnecting said decorative casket shell to said compartment.

9. The burial casket assembly as recited in claim 8, further comprising:

said coupling bar having an end portion that extends outside said decorative casket shell; and an ornamental end block releasably coupled to said end portion, said ornamental end block configured to decoratively conceal the presence of said releasable coupling assembly from an outside observer.

10. The burial casket assembly as recited in claim 9, further comprising:

said end portion of said coupling bar being exteriorly threaded and said ornamental end block being interiorly threaded for releasable interconnection.

11. A burial casket assembly for accommodating inexpensive burials, said burial casket assembly comprising:

a closable burial compartment configured to accommodate enclosure of a body within an interior thereof for burial, said compartment being releasably attached within a decorative casket shell thereby accommodating disengagement of said compartment from said casket shell for burial of said compartment exclusive of said casket shell;

a releasable coupling assembly interconnecting said compartment to said casket shell, said releasable coupling assembly comprising a tube disposed within said compartment and an insertable pin in combination, said insertable pin having an end portion exposed exteriorly outside said compartment and said casket shell; and a removable ornamental end block releasably connected to and covering said exposed end portion of said insertable pin, said removable ornamental end block being configured to decoratively conceal from view said releasable coupling assembly.

12. The burial casket assembly as recited in claim 11, further comprising:

said tube and said insertable pin each being width-wise oriented across said burial casket assembly, perpendicular to the body enclosed within said compartment.

13. The burial casket assembly as recited in claim 11, further comprising:

said insertable pin having a permanent ornamental end block fixed on one end thereof.

14. The burial casket assembly as recited in claim 11, further comprising:

said removable ornamental end block being coupled to said insertible pin via a threaded connection.

* * * * *